United States Patent [19]

Gombas

[11] 4,454,742

[45] Jun. 19, 1984

[54] BOTTOM ROLL-FORMING METHOD AND APPARATUS AND RESULTANT CAN END CONFIGURATION

[76] Inventor: Laszlo A. Gombas, Rte. 7, Box 555Q, Evergreen, Colo. 80439

[21] Appl. No.: 401,915

[22] Filed: Jul. 26, 1982

Related U.S. Application Data

[60] Division of Ser. No. 138,856, Apr. 8, 1980, Pat. No. 4,341,321, which is a continuation-in-part of Ser. No. 931,124, Aug. 4, 1978, Pat. No. 4,294,097.

[51] Int. Cl.[3] ..... B21D 51/26

[52] U.S. Cl. ..... 72/115; 72/348

[58] Field of Search ..... 72/94, 115, 124, 126, 72/348, 379, 349; 220/66, 70

[56] References Cited

U.S. PATENT DOCUMENTS

| | | | |
|---|---|---|---|
| 3,618,549 | 11/1971 | Kaminski | 72/94 |
| 3,998,174 | 12/1976 | Saunders | 72/348 |
| 4,294,097 | 10/1981 | Gombas | 72/94 |

*Primary Examiner*—Lowell A. Larson
*Attorney, Agent, or Firm*—Kyle W. Rost

[57] ABSTRACT

A generally dome-shaped end closure for a receptacle, such as, the bottom end wall of a beverage container is roll-formed in a closely coordinated sequence of steps wherein the receptacle is fixed in position so that the external surface of the end wall to be formed is disposed in facing relation to a yieldable support, and rotatable bearing surfaces are simultaneously advanced into engagement with the end wall while being continuously rotated about a common axis whereby to form one or more annular ribs in the end wall while forcing the end wall to assume a generally convex or dome-shaped configuration as it is expanded outwardly against the yieldable support. A roll-forming apparatus for carrying out the method of the present invention permits a succession of end walls to be roll-formed on a revolving turret which carries a plurality of roller assemblies, each roller assembly defining the rotatable bearing surfaces which are rotated by a spindle drive, the spindle drive being axially advanced by a cam member as it is rotated to cause the associated roller assembly to advance axially through the interior of each receptacle for the roll-forming operation followed by retraction away from the receptacle whereupon the yieldable support is operative to release the can from its fixed position for unloading into a separate stacking area.

3 Claims, 11 Drawing Figures

BOTTOM ROLL-FORMING METHOD AND APPARATUS AND RESULTANT CAN END CONFIGURATION

CROSS REFERENCE TO RELATED APPLICATION

This application is a division of application Ser. No. 138,856, filed Apr. 8, 1980, now U.S. Pat. No. 4,341,321 granted July 27, 1982.

Which is a continuation-in-part of copending U.S. patent application Ser. No. 931,124, filed Aug. 4, 1978, now U.S. Pat. No. 4,274,097 granted Oct. 13, 1981.

This invention relates to metal forming methods and apparatus and more particularly relates to a novel and improved container end closure, such as, the bottom end wall of a can, and method for making same as well as to a novel and improved apparatus employed in the method of carrying out the present invention.

BACKGROUND OF THE INVENTION

Various techniques have been advanced for the fabrication of can bodies and end closures therefor, principal emphasis being placed upon obtaining the highest possible strength with the least amount of material. Representative of prior art methods which have been employed for forming container ends is that disclosed in the U.S. Letters Patent to Fraze U.S. Pat. No. 3,572,271. As discussed in that patent, significant cost savings can be realized from a reduction in the amount of metal or material required in making the can end.

Similarly, U.S. Letters Patent to Saunders U.S. Pat. No. 3,998,174 discloses the formation of a steel container starting with a blank in the form of a shallow depth cup having a thickness on the order of 0.008" to 0.011", ironing only the sidewall of the container to elongate and thin it to about 0.0025" to 0.004", then a bottom end wall profile is formed between complementary male and female profile-forming members to result in an outer chime or rib in an inner recessed panel across the major surface area of the bottom. Numerous other patents discuss and propose different approaches to the formation of can ends, such as, U.S. Letters Patent to Heffner U.S. Pat. No. 3,957,005 and Wolfe U.S. Pat. No. 3,831,416.

Although different forming operations have been proposed for reducing the wall thickness of an end closure for a container so as to result in a corresponding reduction in amount of material, weight and cost, none to the best of my knowledge takes the approach of roll-forming the end wall from the interior of a container in such a way as to effect thinning of the metal across the end panel by rolling out the can bottom wall beyond the bottom edge or end of the sidewall which permits the utilization of thinner starting blank gauges while increasing the volume of a container as well as increasing the strength along the bottom wall. The approach is desirable also from the standpoint of reducing original can height, minimizing handling of the can body, and permitting a positive advancing force to be applied from one side only of the end wall in such a way as to assure more uniform thinning or drawing of the metal into a substantially uniform thickness.

SUMMARY OF THE INVENTION

It is therefore an object of the present invention to provide for a novel and improved method and apparatus for forming an end closure for a container in an efficient, reliable and dependable manner and in such a way as to realize substantial metal savings.

It is another object of the present invention to provide for a novel and improved method and apparatus for forming an end closure which is of increased strength while expanding the effective volume of the container and achieving reduction both in the amount and weight of material required as well as the steps required in handling and processing each container.

A further object of the present invention is to provide for a novel and improved method and apparatus for roll-forming the bottom end wall of a generally cup-shaped container in which close coordination is achieved between the container feed and roll-forming operation so as to permit the handling of a maximum number of containers within the least possible time.

A further object of the present invention is to provide for a bottom roll-forming method and apparatus for forming end closures for pressure resistant containers in which force is applied to one side of the end closure to effect selective thinning and increase in strength of the end closure while at the same time increasing the effective volume of the container.

An additional object of the present invention is to provide for a novel and improved end panel for pressure resistant containers and the like in which the end panel is characterized by possessing increased strength while increasing the effective volume of the container and is adaptable to be formed either out of a flat metal blank or it may later be affixed to the end of the container or may be formed out of a generally cup-shaped blank wherein the end wall forms a unitary continuation of the sidewall of the container.

A particular feature of the present invention resides in the method of roll-forming the end wall of a generally cylindrical container which may be composed either of sheet metal, aluminum alloy, or in certain cases non-metallic materials, such as, plastic or paper. For instance, a generally cup-shaped receptacle which is open at one end and provided with a unitary bottom end wall at the opposite end is fixed in position with the external surface of the end wall in facing relation to the end surface of a yieldable member which is grooved to conform to the desired cross-sectional configuration of the end wall. Once fixed in position, a roller assembly, which is mounted for rotation about the longitudinal axis of a spindle while being independently rotatable about its own forming roller axis, is advanced axially through the interior of the receptacle into engagement with the end wall; and by rotation of the spindle while continually advancing same in an axial direction the roller assembly will force the end wall into engagement with the yieldable end surface. In the first phase of the roll-forming operation, the generally convex face of the dome or end wall will resist the roll-forming forces to provide a certain degree of metal control; and in the second phase, the yieldable end surface is so constructed and arranged as to press the dome face in a direction opposite to the rolling rool so as to cooperate in providing the desired metal control. By aligning the roller assembly with the groove in the end surface of the yieldable member, it will roll form an annular rib in the end wall while forcing the end wall to assume a generally convex or dome-shaped configuration as it is forced outwardly against the yieldable member. Once the roll-forming operation is completed, the spindle is retracted from the receptacle and, upon releasing the receptacle from its fixed position, the yieldable member will urge the receptacle into a discharge area and the next receptacle in succession may be advanced into position for roll-forming in the manner described.

Preferably, in carrying out the method of the present invention, an apparatus is employed in which the spindle drive includes a cam drive for axially advancing the spindle and roller member into engagement with the end wall as the spindle is being continuously rotated; and once the end wall is roll-formed as described the cam drive will automatically retract the spindle away from the receptacle. Preferably a plurality of spindle drivers are mounted on a turret for rotation about a common drive axis, and a series of receptacles are successively advanced into alignment with a spindle drive by a star wheel also rotatable together with the main drive axis. The yieldable member is preferably defined by a combination of a spring-loaded ejector pin and sleeve which are axially yieldable in a direction away from the direction of axial advancement of the spindle drive as it is rotated simultaneously about the main drive axis. The can feed mechanism employed includes an outer retainer in the form of bristles, a brush or other high friction, flexible material along the outside of the guide path for each receptacle to carry it into alignment with the rotating star wheel, the star wheel including a holder which will receive the receptacle and hold it against the outer retainer over a predetermined time interval sufficient for the roll-forming operation to be performed, after which the receptacle is ejected by the yieldable member and discharged into an unloading ramp.

Both in the method and apparatus described, preferably two diametrically opposed pair of roller members are symmetrically positioned for rotation on the spindle drive, one pair of primary rollers having a common axis disposed normal to the longitudinal axis of the spindle drive, and the other pair of secondary rollers which is displaced 90° from the first pair, have separate axes disposed at an acute angle to the spindle drive. The yieldable ejector assembly is provided with a grooved end surface having an annular groove aligned with the secondary rollers and conforming to the desired grooved configuration of the inner rib on the end wall, and an outer yieldable sleeve is aligned with the primary rollers so that as the roller members undergo a series of revolutions against the end wall a pair of inner and outer concentric annular ribs are formed. The degree of convexity imparted to the end wall can be closely controlled by the distance of axial advancement of the spindle drive as well as the configuration of a stationary end portion surrounding the ejector pin assembly, but will vary to some extent in accordance with the composition and thickness of the material out of which the receptacle is formed. By roll-forming in this manner, the thickness of the end wall will be reduced in accordance with the depth or extent of draw as well as the depth of the rib formed in the end wall by the rollers. However, reduction in thickness, or thinning, is closely controlled by the manner in which the roll-forming force is applied to one side of the end wall only. The rolling contact between the forming tool elements and the end wall will result in the development of localized compressive stresses in the material. This compressive stress, as imposed for instance on a single element of material taken from the wall being roll-formed will introduce an elongation upon that single element in the plane opposite to the compressive forces. Thus, the simultaneous development of elongated and compressive stresses upon that illustrative single element will establish a preferential biaxial stress condition. The biaxial stress condition as in contrast to the so-called uniaxial stress condition will secure the maximum range of enclosure wall reduction rate, or the most efficient manner of forming the desired enclosure configuration.

The resultant article formed is characterized by increasing the total effective volume of the receptacle so that for a given desired volume the initial length of the receptacle may be reduced; yet any reduction in strength that would be normally realized as a result of thinning of the end wall is more than compensated for by the dome-shaped configuration of the end wall with one or more reinforcing ribs disposed in concentric relation to one another. As a result, thinner starting gauges can be utilized resulting in substantial metal savings in excess of 9% over present manufacturing technology. Moreover, the configuration of the bearing surface can be closely controlled to provide different specific rib configurations. In the preferred embodiment, the end wall is comprised of an outer concentric rib which projects in an axial direction for a slightly greater distance than the inner concentric rib and is provided with a flat surface so as to serve as the base of the can. This outer concentric rib is joined to the sidewall of the receptacle by an inclined or generally convex sidewall, and is joined to the inner concentric rib by a generally concave surface. The central area within the inner concentric rib may form a recessed section which is either of concave, flat or generally convex cross-sectional configuration.

Other objects, advantages and features of the present invention will become more readily appreciated and understood from a consideration of the following detailed description of the preferred embodiment when taken together with the accompanying drawings, in which:

DETAILED DESCRIPTION OF THE PREFERRED END WALL CONFIGURATION AND METHOD OF ROLL-FORMING

Figure 1:
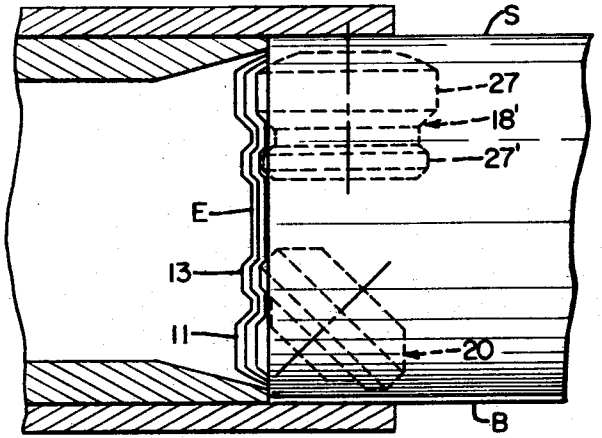
FIG. 1 is a somewhat diagrammatic view illustrating the development of the end wall of a can blank into a somewhat dome-shaped configuration in accordance with the present invention.
Figure 2A:
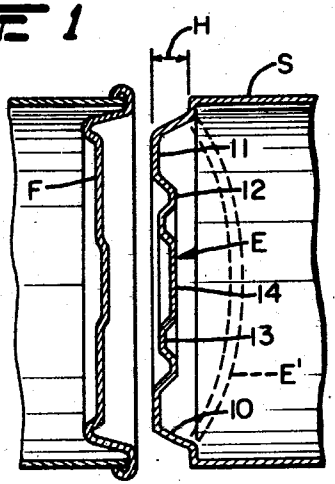
FIGS. 2A and 2B are cross-sectional views illustrating in more detail the cross-sectional configuration of the end wall of a two-piece can and three-piece can, respectively, in accordance with the present invention.
Figure 2B:
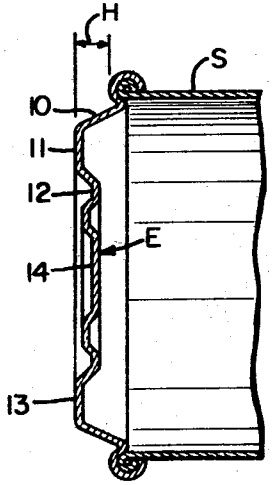

Referring in more detail to the drawings, FIGS. 1, 2A and 2B illustrate the preferred practice followed in the formation of the bottom end wall E of a can body into a generally dome-shaped configuration, as opposed to the conventional configuration in which the bottom panel of the can is essentially flat or formed into a generally concave or recessed end panel. In the preferred form of the present invention, a generally cup-shaped blank B having an outer sidewall S and end panel E has the end panel rolled and stretched in a direction extending axially away from the sidewall S so as to result in an outer inclined wall portion 10 merging into an outer concentric, relatively flat-surfaced rib or pad 11 which is intended to form the base or lowermost edge of the can. The foot or pad is then reverse-curved into a concave portion 12 followed by an inner concentric rib 13 and finally into a central generally concave or recessed area 14. In the generally circular configuration of the can the bottom panel E as described is given increased strength not only by virtue of the overall convex configuration or doming of the panel E but as well by the formation of the inner and outer concentric ribs 11 and 13 which lend the necessary rigidity or resistance to collapse of the bottom panel E while permitting the metal in the bottom panel to be stretched into the configuration as shown. Accordingly, metal savings are achieved while affording increased volume, when compared with a flat end panel or the conventional type of concave end panel as represented at E' in FIG. 2A. Further, the increased strength across the bottom panel will serve as a means of reinforcing the outer sidewall S of the can so as to permit utilization of thinner gauge metal blanks.

For the purpose of illustration and not limitation, for a 12 oz. aluminum can having a height of 4.812", an outside diameter of 2.603" and a gauge of 0.0125", it has been found that by the formation of the end wall E into a dome, as opposed to the concave end wall E' as shown in FIG. 2A, the thickness can be reduced to a wall thickness of 0.0115" while at the same time resulting in an increased volume on the order of 1.855 cubic inches. Thus the overall height of the cup-shaped blank B may be reduced by 0.3485" and achieve a proportionate reduction in weight. Further a reduction of 0.001" in wall thickness will result in an overall reduction of 0.5688 lb. per thousand in the sidewall S and a reduction of 0.5225 lb. per thousand across the end wall E. The resultant total weight savings in a 12 oz. can therefore is on the order of 2.7665 lb. per thousand or an equivalent of 9% in metal savings. Of course the gauge or wall thickness will necessarily vary with the strength and type of material employed and its intended application. It will be evident however that the formation of the end wall not only achieves a thinner starting gauge or wall thickness in the cup-shaped blank employed but at the same time will enable use of a smaller or shorter can blank for a given can volume. However, the increase in depth H resulting from expansion of the end panel into the dome-shaped end, as shown in FIGS. 2A and 2B, will compensate for the reduction in height of the can blank so that the completed blank will be of a height corresponding to that of a standard can.

Figure 3:
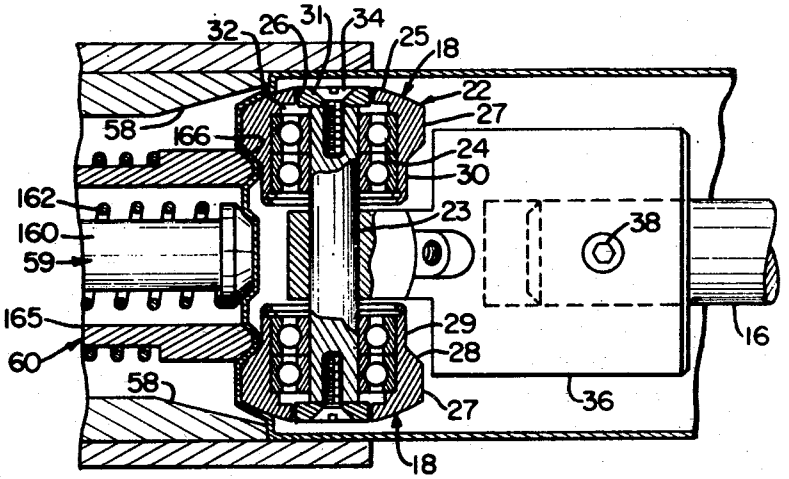
FIG. 3 is an enlarged view with the primary rollers shown partially in section of a preferred form of roller assembly in accordance with the present invention.
Figure 4:
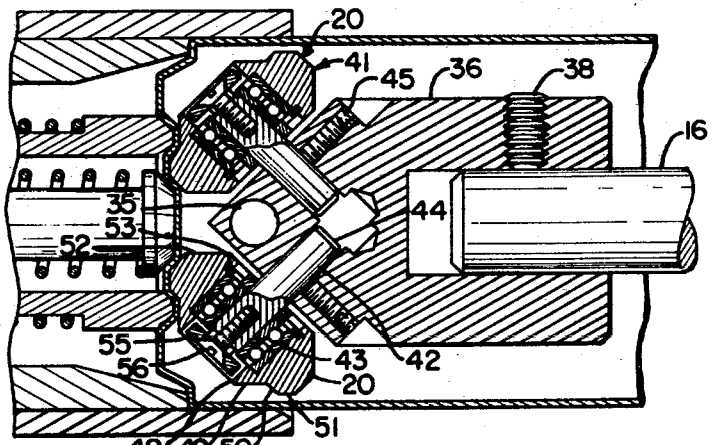
FIG. 4 is another enlarged view with the secondary rollers shown partially in section of the preferred form of roller assembly.

As illustrated in FIGS. 3 and 4, the method of the present invention is preferably carried out through the utilization of two pairs of diametrically opposed rollers where each pair is displaced 90° from the other pair, and the roller pairs are mounted for rotation about the longitudinal axis of a common spindle 16. Specifically, the roller pairs include a first pair of diametrically opposed primary rollers 18 which are journaled on a common axis normal to the longitudinal axis of the spindle 16, and a pair of secondary rollers 20, each journaled for rotation about an axis disposed at an acute angle to the spindle axis. Here, the primary roller pairs 18 are so mounted and configured as to form the outer concentric rib or pad 11, and the secondary roller pads 20 are so mounted and configured as to simultaneously form the inner concentric rib 13.

Each primary roller 18 has a generally cup-shaped body 22 mounted for rotation on a roller shaft 23 by ball bearings 24. The body 22 includes an outer convex, annular end surface 25 having a central opening 26 and curving outwardly into an external bearing surface 27 which extends parallel to the rotational axis of the roller and which has a width corresponding to the desired width of the outer concentric rib 11. A rearwardly convergent surface 28 inclines away from the outer bearing surface 27 into a relatively thin wall portion 29. A snap ring 30 is disposed as an end retainer at one end of the ball bearings 24, and at the opposite end a washer 31 together with spacer 32 are secured to the end of the roller shaft 23 by a flat head screw 34. The roller shaft 23 is inserted through a bore 35 in an end fitting 36 on the end of spindle 16. The end fitting includes a socket 37 to receive the end of the spindle 16, and the entire fitting is anchored to the spindle by lock screw 38.

The secondary rollers 20 are similarly formed with a generally cup-shaped body 41, each journaled for rotation on an independent roller shaft 42 by a ball bearing assembly 43, and each roller shaft 42 is independently affixed in an angular bore 44 in the end fitting by a lock screw 45. The rollers 20 are displaced 180° to one another and 90° from each of the roller pairs 18, and each secondary roller 20 has a flat end surface 48, a first rearwardly inclined bearing surface 49 which diverges into a second inclined bearing surface 50 on the forward or leading end of the outer bearing surface 51. The surfaces 49, 50 and 51 cooperate to form the inner concentric rib 13, as shown in FIG. 4, and a rearwardly convergent surface 52 extends away from the bearing surface 51. Each ball bearing assembly 43 is secured in place by a snap ring 53 at one end and by a spacer 55 which is secured in the central opening of the cup-shaped body of the roller by a flathead screw 56. Preferably the mounting of the inclined or secondary roller pairs 20 with respect to the primary roller pairs 18 is such that a tangent passing through the external bearing surface 27 at its point of engagement or surface contact with the end panel of the can will be in a plane parallel to and just outwardly or beyond the inclined bearing surface 50 on each secondary roller.

The method of the present invention is carried out by placing a generally cup-shaped blank B as described in a position axially aligned with the splindle axis and with the open end of the blank B disposed in closely spaced, confronting relation to the roller pairs 18 and 20. A yieldable roll-forming pattern or support is defined by an outer fixed, inclined or beveled wall 58 together with yieldable members as represented at 59 and 60 which are configured to correspond with the desired cross-sectional configuration of the ribs 11 and 13 of the bottom end wall E of the blank and are disposed in spaced, confronting relation to the exterior surface of the end wall E. By advancing the spindle 16 in an axial direction through the open end of the blank to bring the roller pairs 18 and 20 into engagement with the internal surface of the end wall E and by simultaneously rotating the spindle as it is axially advanced, the roller pairs 18 and 20 will be caused to rotate about the spindle axis while being independently rotatable about their own axes. Under continued axial advancement, the roller pairs will force the end wall E in an axial direction away from the sidewalls S so as to urge the end wall against the yieldable members 59 and 60. The opposing forces of the yieldable members are such that the bearing surfaces 27 and 50 will introduce a biaxial stress condition in the metal as earlier described as it gradually draws the end wall E into the spaces between the members 59 and 60 and outer wall 58. As the rollers undergo a series of revolutions around the spindle they will finally cause the end wall E to assume the desired configuration as shown in FIGS. 1 and 2. Specifically, the primary rollers 18 will roll-form an axially directed, annular rib 11 in the end wall E while forcing the end wall to assume a generally convex or dome-shaped configuration as it is forced outwardly against the outer wall 58. Simultaneously the roller pairs 20 and specifically the inclined bearing surfaces 49 and 50 in cooperation with the bearing surfaces 51 will cause the inner concentric, annular rib 13 to be formed progressively in the manner shown in FIG. 1 as the roller assembly undergoes a series of revolutions about the spindle 16. Preferably the rollers will continue to rotate an additional number of revolutions necessary to iron the metal and assure a substantially uniform thickness. Once the roll-forming step is completed, the spindle 16 is retracted from the cup-shaped blank B, the blank is released and the yieldable members 59 and 60 will urge or kick the blank away from its aligned position with the spindle in preparation for roll-forming the next blank in succession.

DESCRIPTION OF PREFERRED APPARATUS

Figure 5:
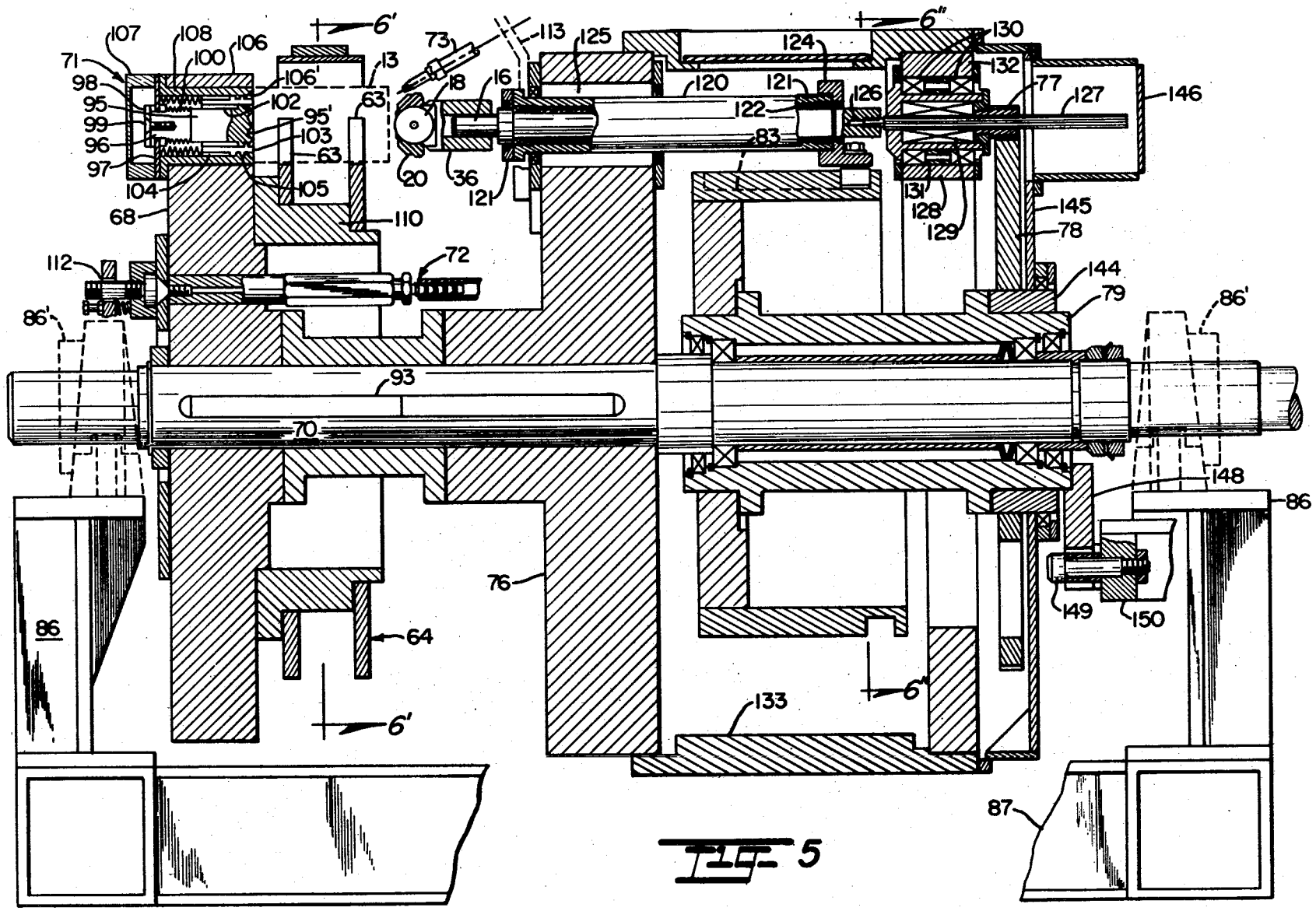
FIG. 5 is a longitudinal cross-sectional view of a preferred form of roll-forming apparatus in accordance with the present invention.
Figures 6, 7:
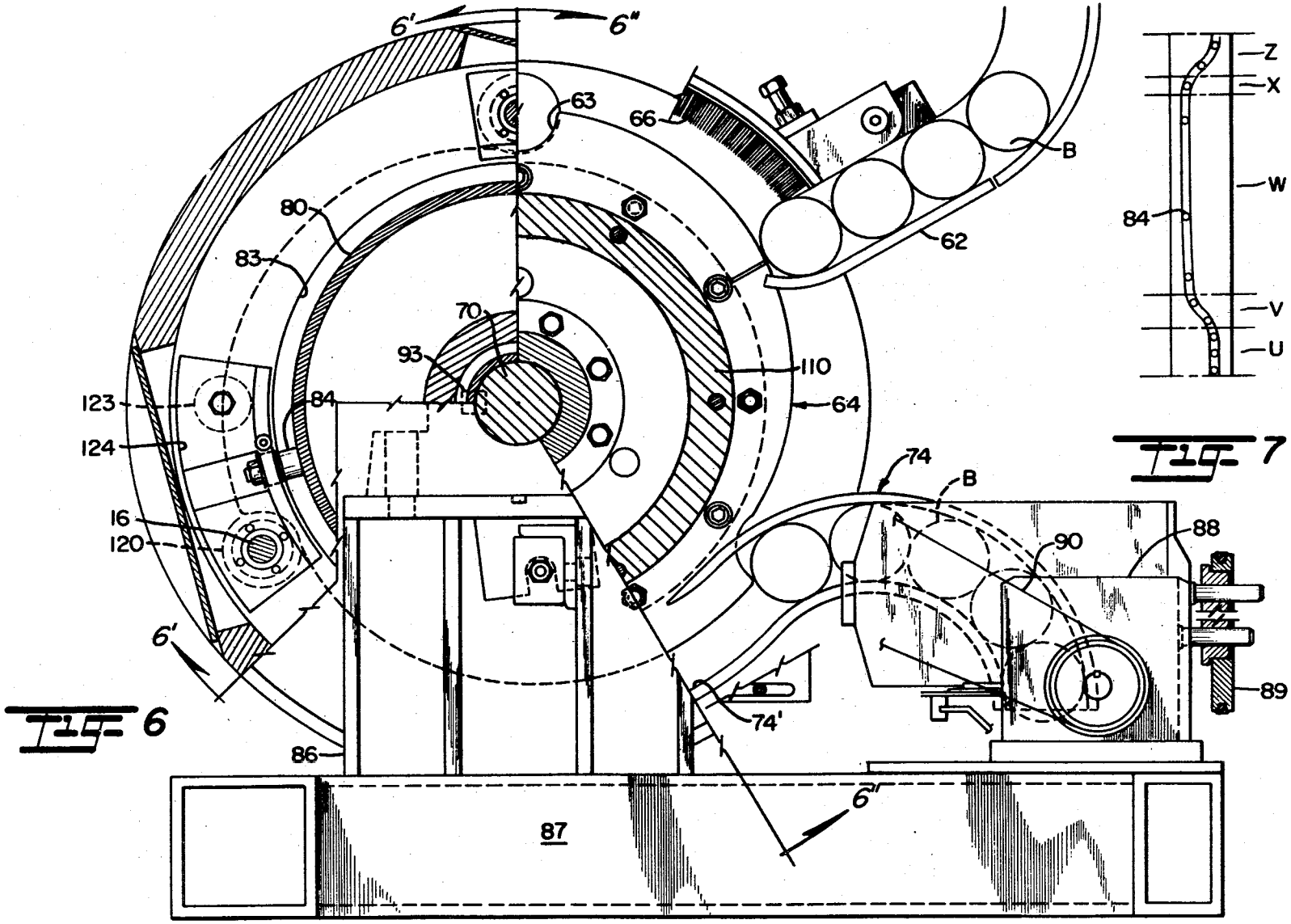
FIG. 6 is a series of end views of FIG. 5, the cross-sectional view designated at 6' being taken through the star wheel section, the cross-sectional view designated at 6" being taken through the ends of the cam and guide ram section, and the end view designated at C being taken from the drive end.
FIG. 7 is a development of the cam groove for controlling axial advancement of the roller assembly.

The preferred apparatus for carrying out the method of the present invention is shown in FIGS. 5 and 6 wherein a continuously revolving turret 61 is utilized for simultaneously roll-forming a plurality of can blanks B which are successively delivered through an inlet feed track or chute 62. The chute is adapted to gravity feed the can blanks into each of a series of can holders or pockets 63 located on a star wheel 64. The cans are stacked in side-by-side relation in the inclined chute 62 so as to successively move into position to be engaged by the pockets 63, where specifically the pockets are formed by a pair of spaced, parallel correspondingly shaped concave surfaces which curve in an outward radial direction from the peripheral surfaces 65 of the star wheel and are formed on an arc whose radius corresponds substantially to that of the cross-sectional radius of the can blank to be roll-formed and extend for a distance corresponding to approximately one-third the circumferential extent of the sidewall S of each can blank. A can hold-down member 66 is positioned in spaced outer concentric relation to a can pocket 63 and provides an outer peripheral, frictional surface, such as, relatively stiff bristles which are adapted to engage the outer surface of each can blank 13 and guide it into position in the can pocket as it leaves the infeed chute 62. Both the can hold-down member 66 and the star wheel 64 are supported for rotation on a common guide block 68 which is keyed for rotation to the main drive shaft 70 of the turret mechanism 61. Similarly, the yieldable support referred to earlier, which cooperates in roll-forming the end wall of each can blank as well as to discharge the can blank at the end of each roll-forming operation, is defined by a series of ejector pin assemblies 71 mounted for rotation with the guide block 68, there being an ejector pin assembly 71 aligned with each of the can holders 63 on the star wheel. A corresponding number of air nozzle assemblies 72 are mounted on the guide block, each including an air nozzle 73 for directing air under pressure into the interior of each can blank to force it against the stationary end of each ejector pin assembly. Each can blank B is discharged at the end of the roll-forming operation through an unloading chute or ramp 74 which has a scoop or entrance portion 74' located at the lower end of the star wheel and approximately 210° removed from the can infeed track 62 to remove each blank from the star wheel. Although the unloading ramp may take any suitable form, it is illustrated in FIGS. 5 and 6 as being of generally reverse-curved configuration so as to permit each roll-formed can to pass initially along a slight upward incline then to drop by gravity through a downwardly inclined passage into a suitable stacking area, not shown.

In the preferred form, three can holders and a corresponding number of ejector pin assemblies are positioned at equally spaced, 120° intervals about the outer periphery of the star wheel and guide block, respectively, so that as each can in succession is advanced from the can infeed track 62 onto one of the can holders 63, the next preceding can holder is aligning and positioning a can during the roll-forming operation, and the third can holder has just deposited or discharged a can and is moving through a limited dwell period in preparation for picking up the next can in succession. Accordingly there are a corresponding number of roller assemblies aligned with each of the can holders 64 and mounted for rotation in closely coordinated relation to the can holders; and each spindle 16 must be independently rotated about its own axis while selectively advancing and retracting the primary and secondary rollers 18 and 20 in carrying out the roll-forming operation.

Prior to a consideration of the more detailed construction and arrangement of the turret the general organization and cooperation between parts comprising each roller assembly and spindle drive will now be described. Broadly, in order to coordinate the rotation of the spindle drive with each of the respective can holder assemblies, the spindles are mounted at equally spaced 120° intervals on a common spindle housing 76 which is keyed for rotation with the main drive shaft 70; and further the spindle housing imparts rotation to each spindle 16 independently of the rotation of the main drive shaft through the interaction of a pinion 77 which rotates about a stationary bull gear 78. The bull gear is held stationary with respect to the main drive shaft by mounting on a planetary gear hub 79, and a cam 80 is also mounted on the same planetary gear hub and has an outer generally drum-shaped portion 82 provided with a continuous, generally helical groove 83 to impart the desired axial movement to a cam follower 84 at the trailing end of a guide ram 85. Thus as each spindle 16 is rotated it is also caused to move reciprocally in an axial direction thereby causing axial movement of the associated rollers 18 and 20 toward and away from a can blank B which is held in position on the star wheel and is rotated synchronously with the spindle housing.

Reviewing in more detail the features of construction and arrangement of the roll-forming apparatus, the main drive shaft has opposite ends supported in bearings 86' on pillow blocks 86 which are supported on a common base 87. Rotation may be imparted to the main drive shaft 70 by any suitable drive means such as an electric motor 88 through a speed reducer 89 and chain drive 90 into a sprocket, not shown, keyed to one extreme end of the main drive shaft 70. The guide block 68, an annular spacer block 92 and spindle housing 76 are mounted for rotation on the main drive shaft 70 by a key 93 inserted into a keyway extending along the main drive shaft, as shown, and the spacer block 92 is fixed both to the guide block and spindle housing.

Each ejector pin assembly 71 which defines a yieldable support for the end wall E is inserted in a throughbore or passage adjacent to the outer peripheral end of the guide block 68. The specific form of yieldable support as shown in FIG. 5 is modified somewhat from that illustrated in FIGS. 3 and 4 wherein the central ejector pin 95 of each assembly is of solid cylindrical configuration and has an axial extension 96 of reduced diameter which projects rearwardly through a retainer plate 97 and is secured in place by a thrust washer 98 and screw 99 passing into the axial extension through the thrust washer 98. A disc spring 100 is disposed in surrounding relation to the axial extension between the shoulder on the ejector pin and a wear spacer 101 so as to normally spring-load the ejector pin in a direction toward the roll-forming assembly. The end of the ejector pin facing the star wheel is provided with an annular groove 95' corresponding to the desired configuration of the inner rib 13. A bushing 102 on the external surface of the ejector pin is disposed for slidable movement within an ejector sleeve 103 which in turn has a bushing 104 and O-ring 105 interposed between the external surface of the sleeve and the ejector housing 106. A cover 107 is disposed over the end of the retainer plate 97 and a series of disc springs 108 are interposed between the end of the ejector sleeve 103 and the retainer plate 97 so as to yieldably resist movement of the ejector sleeve toward the retainer plate. Suitable fasteners, not shown, are passed through the cover 107, retainer plate 97 and outer flanged end of the keeper bushing into the wall of the guide block in order to mount the entire ejector pin assembly in place on the guide block. Under the urging of the roller assembly against the end wall E of a can blank B, the outer primary rollers 18 will force the ejector sleeve 103 rearwardly against the spring-loading of the outer disc 108 as the secondary rollers 20 are forcing the inner concentric portion of the end wall E rearwardly against the ejector pin 95. The outer beveled end surface 106' of the housing will cooperate with the primary rollers 18 in forming the outer inclined wall portion 10 as the primary rollers 18 continue to expand the end wall E in a rearward direction against the urging of the ejector sleeve 103; and the secondary rollers will simultaneously displace the metal of the end wall into the annular groove 95' on the end surface of the ejector pin 95 to form the inner concentric annular rib 13.

The star wheel 64 cooperates with the housing 106 to retain the can blank B in fixed position both against rotation and axial displacement. As noted, the can holders 63 of the star wheel are mounted in axially spaced relation on an annular support block 110 which in turn is supported on a shoulder portion of the guide block 68. Each air nozzle assembly 72 has an air inlet connection as generally represented at 112 through a passageway formed in the guide block in spaced inner concentric relation to each ejector pin assembly 71. The air nozzle assembly is of conventional construction and therefore will not be described in detail but does provide a source of air under pressure to the air nozzle 73, the latter being mounted on a suitable support bracket 113 so that the nozzle is inclined rearwardly and downwardly directly above each of the roller assemblies.

Each of the roller assemblies includes a hollow cylindrical fitting 36 which is secured in pressfit relation to the end of an associated spindle 16, the spindle in turn extending rearwardly through a hollow cylindrical guide sleeve 120 and being journaled with respect to the guide sleeve 120 by ball bearings 121 at each end which are separated by a bearing spacer sleeve 122. The guide sleeve is axially movable through a bore in the spindle housing, and a guide ram 123 is juxtaposed with respect to the guide sleeve by a tie bar 124 at one end opposite to the roller assembly and also extends through a bore in the spindle housing 76. Each spindle 16 is arranged coaxially with respect to a respective ejector assembly 71 while being supported for slidable movement in an axial direction through the spindle housing by linear bearing 125. The end of the spindle 16 opposite to the roller assembly is provided with a threaded counterbored end 126 adapted to receive the reduced, threaded end of a splined shaft 127. The splined shaft 127 extends through a drive hub 128 having a ball-nut assembly 129 which follows the rotation of the pinion 77 around the bull gear 78, and the splined shaft 127 is free to follow the axial movement of the spindle 16 as it is rotated by the ball-nut assembly 129 and imparts that rotational movement to the spindle 16. The drive hub 128 in turn is journaled within ball bearings 130 which are separated by spacers 131, and the bearings 130 are disposed within a spacer ring 132 which is affixed to another spacer ring 133 to the outer peripheral end of the spindle housing 76. A typical type of ball-nut assembly is that manufactured and sold by Saginaw Steering Gear Division of General Motors Corporation, Detroit, Mich.

It will be seen that as the entire drive hub 128 is rotated with the spindle housing, the splined shaft 127 is free to rotate independently about its own axis to impart rotation to the spindle 16 as well as to follow axial advancement of the spindle 16 as described. The tie bar 125 imparts axial movement to the guide sleeve 120 and ram 123 under the control of the cam follower 84 which is guided by the helical cam groove 83, shown in FIG. 7, in the external surface of the cam 80 so that over a period of approximately 180° the spindle drive is caused to move forwardly through each can blank B to roll-form the end wall E of the blank followed by retraction from the can blank before the star wheel has reached the unloading ramp 74. The cam 80 is permanently affixed to the planetary gear hub 79, and in turn the planetary gear hub 79 is journaled with respect to the main drive shaft 70 by bearings 140 which are separated by a spacer sleeve 141 and spring 142. An annular ring or spacer 144 supports the bull gear 78 in fixed relation to the planetary gear hub. A drive cover or housing 145 is supported on the spacer 144 and includes an annular access cover 146 over the splined shaft 127 so as to enclose the entire end of the turret, the cover 146 being recessed so as to form an annular space for free movement of the splined shaft 127 in following the rolling advancement of the pinion 77 around the bull gear 78. The end of the planetary gear hub 79 projects beyond the end of the drive cover 145 and is held against rotation by a torque arm bracket 148 affixed at its lower end to a shoulder screw 149 projecting from pivot arm 150 on the pillow block 86.

The development of the cam groove 83 is illustrated in in FIG. 7 for a number 211/12 oz. standard aluminum can. As represented in FIG. 7, for a complete revolution of a roller assembly about the main drive shaft 70, or 360°, segment U represents a circumferential interval of approximately 50° during which the roller assembly advances after discharge of a completed can into the next segment V of approximately 35° during which the roller assembly is advanced through the interior of the can blank B which has been loaded onto the star wheel in alignment with the roller assembly. The segment or interval W represents a period of 210° during which the roller assembly will continue to undergo a number of revolutions on the order of 12 to 16 revolutions in expanding and roll-forming the bottom end wall E of the can. A limited segment is represented at X to designate that time interval or period during which the roller assembly will continue to bear against the end wall in completing the roll-forming operation as a preliminary to the final segment or time interval Z wherein the cam groove 84 will curve rearwardly to cause the roller assembly to be retracted from the can blank. When the roller assembly is retracted the ejector pin assembly will overcome the resistance of the outer can retainer surface 66 to discharge the can blank into the unloading ramp with the aid of the air nozzle assembly.

Referring specifically to FIGS. 3 and 4, brief mention should be made of that form of ejector assembly wherein a central ejector pin 160 includes an enlarged head or end portion 162 having a generally convex end surface 163 for the purpose of forming the recessed center portion 14. The ejector sleeve 165 has an annular end surface 166 which in cross-section is of generally convex configuration to form the generally convex wall portion 12 between the inner and outer concentric ribs 11 and 13. Specifically, the ejector sleeve 165 will cooperate with the primary rollers 18 in forming the desired configuration of ribs between the fixed sidewall 61 of the ejector assembly and the ejector sleeve and, together with the central ejector pin 160 will cooperate with the bearing surfaces of the secondary rollers 20 in forming the desired configuration of the inner concentric rib 13. Selection of a particular yieldable support member will of course vary to a great extent with the ductility and type of the material being roll-formed.

From the foregoing, it will be recognized that an extremely efficient, high speed apparatus has been devised for metal forming operations and which is specifically adapted for roll-forming a flat circular plate or blank, preferably composed of a ductile material, into a generally dome-shaped, ribbed configuration. While the method and apparatus have been described specifically in connection with roll-forming the end wall of a two-piece can blank, its ready conformability for use in roll-forming a separate end closure out of a flat blank for three-piece cans, as shown in FIG. 2B, will also be appreciated as well as other metal forming operations for either a dome-shaped or ribbed configuration as desired. Moreover, while the apparatus has been described in connection with the formation of inner and outer spaced concentric ribs for strengthening an end wall E as its thickness is reduced, it will be appreciated that it is also readily adapted for forming a single rib or a plurality of ribs in excess of two ribs. Formation of each rib is accomplished preferably by employing a pair of diametrically opposed rollers for each rib to be formed. However, in forming a plurality of ribs a single roller may be provided for each rib with the rollers spaced at equal intervals so that pressure is uniformly applied to the end wall. For the purpose of illustration, the gear ratio between the pinion 77 and bull gear 78 is such that the spindle 16 and attached roller assembly will undergo on the order of 12–16 revolutions in a complete roll-forming operation as each can blank is advanced from the inlet chute 62 to the unloading ramp 74, and an additional 1 to 2 revolutions can be included at the end of the roll-forming sequence when the resistance of the ejector assembly is at its maximum for the purpose of assuring uniform bending and displacement of the metal.

Although the article of manufacture as described specifically in connection with FIGS. 1 and 2 is most desirably formed in a roll-forming operation as described, other methods and apparatus may be employed to produce the same desired configuration, particularly in the formation of a separate end closure as described with reference to FIG. 2B. The preferred practice as indicated earlier is to use a combination of a pair of diametrically opposed rollers 18 normal to the spindle axis and a pair of diametrically opposed rollers 20 at an acute angle to the spindle axis, the roller pairs 20 being operative to form the inner concentric rib as designated at 13. In the alternative, as illustrated in FIG. 1, a modified form of roller 18' can be employed where the diametric difference between the bearing surfaces 27 and 27' is substantially the same as the spacing between the center lines of the bearing surfaces, that spacing being represented at D. In this way, the velocities of the bearing surfaces at their points of contact with the grooves in the end wall will be approximately the same. Although not specifically illustrated in FIG. 1, the modified form of roller 18' would be used in combination with another normally disposed roller 18' in the relationship shown in FIG. 3 and therefore would obviate the need for another pair of diametrically opposed rollers 20 in forming the inner concentric rib 13. However, the roll-forming method and apparatus of the present invention is considered to be particularly advantageous in the formation of a two-piece can of the type illustrated in FIG. 2A, since the more conventional punching and ironing operation would not readily lend iself to the formation of a dome-shaped, ribbed bottom wall as described. It will further be noted that the particular dome-shaped configuration as illustrated in FIGS. 2A and 2B will permit nesting together of a number of cans by insertion of the outer inclined, convergent sidewall portion 10 of the end wall E into the recessed portion of a can lid F of another container as shown in FIG. 2B. Moreover, as a result of the increased volume of the blank designated at V, when the end wall is expanded as described the initial volume or size of the blank can be correspondingly reduced. Stated another way, the increase in can depth can be compensated for by a corresponding reduction in height so as to maintain a constant height, i.e., a height equal to that of the standard cans. FIG. 2B also illustrates the reduction in thickness of the end wall E from that of the wall E', for instance, from a starting gauge of 0.0125" which is reduced during the roll-forming operation in the manner described to an average end wall thickness of 0.0090" or less.

Figure 8:
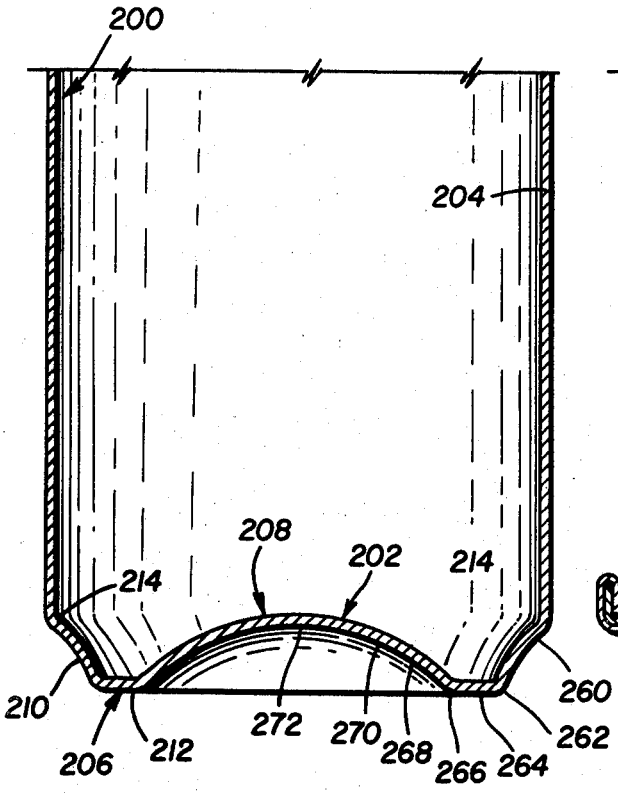
FIG. 8 is a cross-sectional view of a two-piece can body showing another embodiment of the end wall configuration.

In addition to the end wall configuration E of the prior embodiment, wherein a plurality of concentric ribs 11, 13 are formed in the end wall, the invention also includes a can body having a dome shaped end or as little as one rib. FIG. 8 illustrates a can body 200 having an end panel 202 integrally joined to the cylindrical side wall 204, forming the body of a two piece can. The end panel is defined by a single annular rib 206 extending axially below the side wall 204 and circumferentially surrounding a recessed center 208, which may be convex, concave, or flat. The rib 206 has an outer wall 210 inclined with a radially inward component from the side wall 204 and axially outwardly from the can body. The outer wall merges with rib bottom surface 212 at the axial extreme of the end panel, defining a stable resting surface for the can body. The end panel of FIG. 8 curves concavely from the bottom surface 212 to define a recess or axially inwardly extending dome at the center 208 of the end panel.

Figure 9:
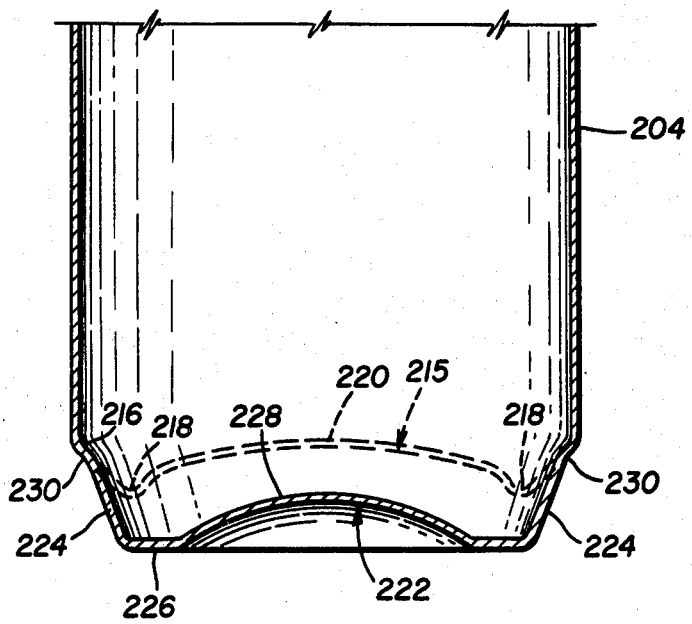
FIG. 9 is a cross-sectional view of a two piece can body, showing the resultant end wall configuration similar to that of FIG. 8 when the starting blank is chamfered at the end.

The rib 206 and some or all of dome 208 are axially below or outward from the bottom line of the can as formed in the original draw and iron or draw and redraw process by which can bodies are presently formed, which create only a mono-axial stress condition in the malleable starting material. If the cup or preexisting can body from which can body 200 was formed had a relatively flat bottom or an inwardly domed bottom, as illustrated by E' in FIG. 2A, the original bottom line would extend approximately between points 214, marking a ridge or step at the intersection of the side wall 204 with inclined surface 210. Other mono-axially stress formed can body configurations are known, at least one of which employs a chamfer or tapering bottom 215 axially below the maximum diameter of the cylindrical side wall, as shown in FIG. 9, where inclined surface 216 is formed in the draw-and-iron or like process. At the axially outward end 218 of the inclined surface 216, the can end 215 may either have a concave dome 220 or a relatively flat bottom extending across the area between the points 218, the former style being used for pressurized applications and the latter being suited for unpressurized use. In either event, the bottom line of such a can body as formed by a mono-axial stress process extends approximately between points 218. When a can body having end 215 is employed as the blank for producing a can according to the present invention, the chambered side 216 and center dome or flat surface 220 are both altered in their configuration to form the end panel 222 having an inclined outer wall 224 longer than wall 216. A bottom pad 226 and central concave or convex dome 228 are present, but the dome may be proportionately smaller than the dome of end wall 202. Depending upon the exact configuration of the dome 228, the dome may be entirely or partially below the bottom line of the starting blank between points 218. At the intersection of the cylindrical side wall 204 and the end panel, a step 230 is formed, similar to step 214 of FIG. 8. Both of these steps mark a transitional point between the cylindrical side wall, which is substantially unaltered in the formation of the roll-formed, bi-axially stressed, can end, and the can end itself, which is altered in its configuration to expand the volume of the can body; and the step provides a position retaining means for the controlled expansion of can volume according to the method and in the apparatus previously disclosed. The step is defined by a wall inwardly inclined with a radial component substantially greater than the radial component of outer wall 224 immediately adjacent to the step.

Figure 10:
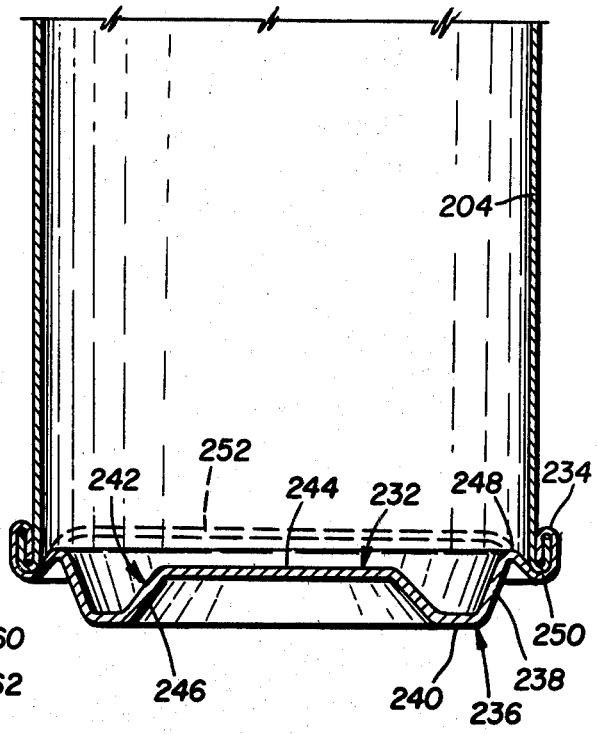
FIG. 10 is a cross-sectional view of a can body having a seamed end, with the end having the configuration similar to that of FIG. 8.

The bottom profiles of FIGS. 8 and 9 may be formed in a variety of two piece can bodies or blanks, in each case expanding the end panel beyond the original bottom line of the blank as produced by draw-and-iron or like mono-axial stress technology, wherein the end panel configuration is produced by mono-axial forming methods. The profile may also be applied to three piece can technology at one or both end closures, or to the end closure of a two piece can body. FIG. 10 shows a cylindrical side wall 204 that may be a portion of either a two or three piece can body. Closure panel 232 is seamed to the side wall 204 at seam 234 in the manner known in the art. The lid defines at least one rib 236 similar to rib 206 in having an inclined outer wall 238 joined to a bottom surface 240, in turn connected to generally concave center 242. However, the concave center may be less domed than the center 208 of FIG. 8 to the extent that the central portion 244 of center 242 may be substantially flat or convex and circumferentially surrounded by a radially and axially outwardly sloping surface 246 joining the rib bottom surface 240 to the central portion 244.

In an end closure, the desired configuration may be attained before the end is seamed to the can wall. For attachment purposes, it is useful to form an axially inwardly extending rib 248 positioned to fit immediately inside the cylindrical side wall 204. The outer wall 238 of rib 236 may be viewed as extending from the axially inward extreme of rib 248 to bottom surface 240; or if the rib 248 is not present, then the outer wall extends from approximately the axial extreme 250 of the can side wall 204 to the surface 240. The end in any case extends beyond the normal bottom line such as wall 252 connecting the points 248, and also extends beyond the seam line at points 250, with the result that surface 240 is at the axial extreme of the can body and center 242 is recessed so that surface 240 provides a stable base even when the can is pressurized.

A can end having one rib as disclosed in FIGS. 8–10 may be formed according to the rolling method and with the apparatus previously described, with the primary rollers 18, FIG. 3, forming the rib. The yieldable supports 59 and 60 may be combined into a single support, as the secondary rollers 20 are eliminated. Other reforming techniques might also be employed to create a larger volume, such methods including spinning, coining, stamping, drawing, and hydroforming, any of which could produce a volume expansion when applied to a closure formed in a single step.

An end panel formed according to the invention is characterized by a number of physical differences from a draw-and-iron or like mono-axial stress formed blank, even though the blank may initially have a somewhat similar ribbed structure, such as the chamfered end 215 in FIG. 9. The roll-formed bottom wall of the new end configuration is considerably thinner, for example ten to sixty percent thinner, than the original blank, which is made possible by the bi-axial stress forming. In addition, the rolled profile has greater hardness due to the cold working of the metal. The central dome of a roll-formed end may be substantially smaller in diameter than that of the draw-and-iron formed blank resulting in greater volume in the rib. Of greatest resultant significance, the rolled bottom line is extended beyond the bottom line obtained by the standard draw-and-iron, draw and redraw or other mono-axial stress forming process, adding volume to the resultant can as compared to the can volume of the draw-and-iron or the like formed can. This results in reduced can weight for equivalent volume, such as a reduction of up to twenty-five percent of can weight. These results are possible because the draw-and-iron and like technology relies primarily upon mono-axial stretching of metal, with the majority of the stretching taking place in the side wall. The end panel of such draw-and-iron formed cans receives only a modest stretching, usually by a doming die in a single step at the end of the forming process. Thus, the thickness of the original sheet stock is substantially unchanged across the majority of the diameter of the end panel as formed in a single step process.

As an example of the end profile than can be obtained with a single rib in a reforming process, the embodiment of FIG. 8 may be viewed as being formed from a standard 12 oz. aluminum can known as the 211 can body, which has an inside diameter of 2.60000 in., and a side wall minimum thickness of 0.005 in. The original sheet stock thickness, prior to the formation of the blank, is 0.0155 in. In FIG. 8, reforming of the end panel has increased the can height by 0.300 in., with 0.200–0.400 in. being typical, depending upon the hardness of the metal. The height increase may therefore be between 0.076 and 0.15 times the inside can body diameter. The diameter of dome 208 may be 1.550 in., or between 1.500 and 1.600 in., which is 0.57 to 0.62 times the inside can body diameter. Representative metal thickness may be, at point 260 adjacent to step 214, 0.014 in.; at point 262, where the wall 210 intersects the bottom 212, 0.013 in.; at point 262 near the mid-point of the bottom, 0.010 to 0.005 in.; at point 266 near the inside edge of the bottom, 0.008 in.; at point 268 approximately one-quarter of the radius into the domed center, 0.013 in.; at point 270 approximately one-half of the radius into the domed bottom, 0.014 in.; and at point 272 at the center of the domed bottom, 0.0155 in., which is substantially the original sheet stock thickness. Thus, the majority of the end panel has been reduced in thickness by at least ten percent of the starting sheet stock thickness, which thickness is substantially preserved as the end panel thickness in can bodies formed according to present practice. When the end panel is reformed in a reworking step as now proposed, a majority of the end panel area is reduced in thickness from the original sheet stock guage. At least a small portion of the reformed end panel, such as the center portion at point 272, would be expected to undergo little or no thinning and may serve as a reference point in the finished container body for determining the thickness reduction of the remainder of the end panel. The minimum thickness of the reformed end panel is dependent upon the chosen configuration, the desired degree of reforming, and the specific alloy employed, but the minimum may be as thin as the minimum thickness of the can side wall, which in FIG. 8 is 0.005 in., which is less than one-third the sheet stock gauge in the example. Thickness reductions of up to forty percent, such as at points 264 and 266, may be reliably achieved, even with a sheet stock as thin as 0.010 in., while in the example reductions of twenty percent and more are found at points such as268 even slightly removed from the end panel areas subjected to the greatest reworking forces.

The noted end panel thickness reductions and corresponding volume increase and metal savings in the resultant container are significant primarily when viewed from the starting point being an already formed can body that has attempted to optimize metal savings. Thus, the starting can body is constructed from the thinnest sheet stock that is useable as a practical matter to form a body of suitable strength and size. Hence, the term "optimized blank" may be applied as referring to a metal container designed for use of the minimum practical amount of metal in the can side wall, which may then be referred to as an "optimized side wall", which is formed from sheet stock by a mono-axial stress forming process, and with the end panel being shaped in a mono-axial primary forming step such as contact with one or more dies at the conclusion of side wall formation in a body making machine. Through secondary forming of such a preformed end panel of an optimized blank, additional metal savings are realized while maintaining the necessary strength of the resultant container, with the strength of the end panel being enhanced when the reforming process employs bi-axial stress forming methods.

It is therefore to be understood that while a preferred embodiment of the present invention is herein set forth and described, the above and other modifications and changes may be made in the article of manufacture, as well as the method and apparatus for forming same, without departing from the spirit and scope of the present invention as defined by the appended claims.

I claim:

1. The method of forming a container body of the type having a cylindrical side wall closed at one end by an integral end wall, comprising:

first, applying mono-axial forming stress to a sheet of malleable material to form an optimized blank; and second, increasing the volume of the optimized blank by applying reforming forces to the end wall of said optimized blank to form a generally dome shaped outward extension that protrudes beyond the bottom line of the optomized blank.

2. The method according to claim 1, wherein said dome shaped extension comprises at least one annular rib.

3. The method according to claim 1, wherein said reforming forces are bi-axially applied to said end wall.

* * * * *